US006009977A

United States Patent [19]

Pelofi

[11] Patent Number: 6,009,977

[45] Date of Patent: Jan. 4, 2000

[54] FALL PREVENTION DEVICE FOR VERTICAL CABLE

[75] Inventor: Pierre-Georges Pelofi, Vierzon, France

[73] Assignee: Dalloz Fall Protection, Vierzon, France

[21] Appl. No.: 09/072,029

[22] Filed: May 5, 1998

[51] Int. Cl.[7] ..... A62B 1/14

[52] U.S. Cl. ..... 182/192; 188/65.2; 24/134 R

[58] Field of Search ..... 182/5, 192, 193; 188/65.2; 24/134 R

[56] References Cited

U.S. PATENT DOCUMENTS

| | | | |
|---|---|---|---|
| 2,540,887 | 2/1951 | Hyatt . | |
| 4,059,871 | 11/1977 | Swager | 24/134 R |
| 4,657,110 | 4/1987 | Wolner | 182/5 |
| 5,146,655 | 9/1992 | Gibbs | 24/134 R |
| 5,472,036 | 12/1995 | Judkins . | |
| 5,860,493 | 1/1999 | Cherpitel . | |

FOREIGN PATENT DOCUMENTS

| | | | |
|---|---|---|---|
| 0272782 | 6/1988 | European Pat. Off. . | |
| 2311213 | 12/1976 | France . | |
| 351602 | 9/1986 | Germany | 182/5 |
| 3644559 | 7/1988 | Germany . | |

*Primary Examiner*—Alvin Chin-Shue

*Attorney, Agent, or Firm*—Greenblum & Bernstein, P.L.C.

[57] ABSTRACT

Device for preventing a fall on a vertical cable, with a channel for guiding the cable, two flanges supporting an axle on which a lever is pivotally mounted, one extremity of the lever including an opening for fixing a link and at the other extremity, a cam which co-operates with the cable in the event that the user falls to block the device along the cable. The flanges are connected via a hinge so that the flanges can be pivoted with respect to each other and moved apart from each other for positioning the device on the cable and closed together whereby the cable is inserted in the channel, and a safety structure is provided to oppose opening of the flanges when the lever does not occupy an angular rest position in which the cam is spaced from the cable.

10 Claims, 4 Drawing Sheets

FALL PREVENTION DEVICE FOR VERTICAL CABLE

BACKGROUND OF THE INVENTION

1. Field of the Invention

The present invention relates to a fall prevention device for a vertical cable, rope or bar.

2. Description of the Prior Art

Fall prevention devices are known which comprise a body which is movable along the cable and which has a cable guiding channel, the body comprising an articulated lever one extremity of which is terminated by a ring bolt for receiving a snap hook connected by a flexible line to a harness carried by the user, while the other extremity of the lever terminates in a cam which, in the event of a fall, blocks the device on the cable by clamping it against the bottom of the channel.

Embodiments are known in which the body is formed by a flange terminated by a cable guide channel and against which a second flange is fixed, a slot being created by them for positioning the device on the cable. In its normal position of use, the cam partially blocks the slot so that the cable cannot inadvertently escape from the channel.

That type of arrangement does not provide the required security.

One aim of the invention is to provide a device with very good security.

SUMMARY OF THE INVENTION

The device of the invention is of a type comprising a body with a channel for guiding on the cable, two flanges supporting an axle on which a lever is pivotally mounted, one extremity of the lever comprising an opening for fixing a snap hook or link to be connected to the harness of a user and, at the other extremity, a cam which co-operates with the cable when the lever pivots in the event that the user falls to block the device along the cable, the flanges being connected via a hinge so that the flanges can be pivoted with respect to each other and moved apart from each other for positioning the device on the cable and closed together whereby the cable is inserted in the channel and a safety mechanism being provided to oppose opening of the flanges when the lever does not occupy an angular rest position in which the cam is spaced from the cable, wherein the lever is integral with a movable pin in a groove in one flange in the form of a circular arc with the pivotal axis of the lever as the center of curvature, the pin being terminated by a head, while the groove comprises, at its extremity corresponding to the rest position of the lever, a hole for passage of the head.

This arrangement with the cable lodged between the flanges and the lever endows the device with greater safety.

Further, since the device cannot be opened without making a particular manipulation, the device is certain to be properly positioned and cannot be inadvertently dislodged.

In a first embodiment, the flanges comprise abutments which oppose the pivoting of the lever towards an angular rest position when a snap hook or other link is mounted in the opening of the lever, the link bearing against the abutments. Thus once the link is in place, the device cannot be opened which prevents the user from making a false move.

Finally, in a further embodiment of the invention, the lever comprises a pin, a first extremity of which is movable in a first groove of on flange and the other is movable in a second groove of the other flange, the two grooves being in an arc of a circle and having the pivotal axis of the lever as its center, the first extremity being integral with a ring, while the other extremity is terminated by a head, the pin being slidably mounted in a bore in the lever against the action of an elastic element which tends to maintain the ring in the first groove, the latter having a narrower portion in its portion corresponding to the angular rest position of the lever, the narrower portion being connected to the other portion of the first groove by a shoulder, while the second groove is terminated by a hole in its portion corresponding to the rest position of the lever, the lever only being capable of being placed in a rest position when the ring has been disengaged from the first groove.

This arrangement creates a safety system in which the device can only be opened while it has not been displaced against the action of the elastic element.

Other features and advantages of the invention will become more apparent from the following description given by way of non-limiting example with reference to the appended drawings.

DETAILED DESCRIPTION OF THE PREFERRED EMBODIMENTS

Figure 1:
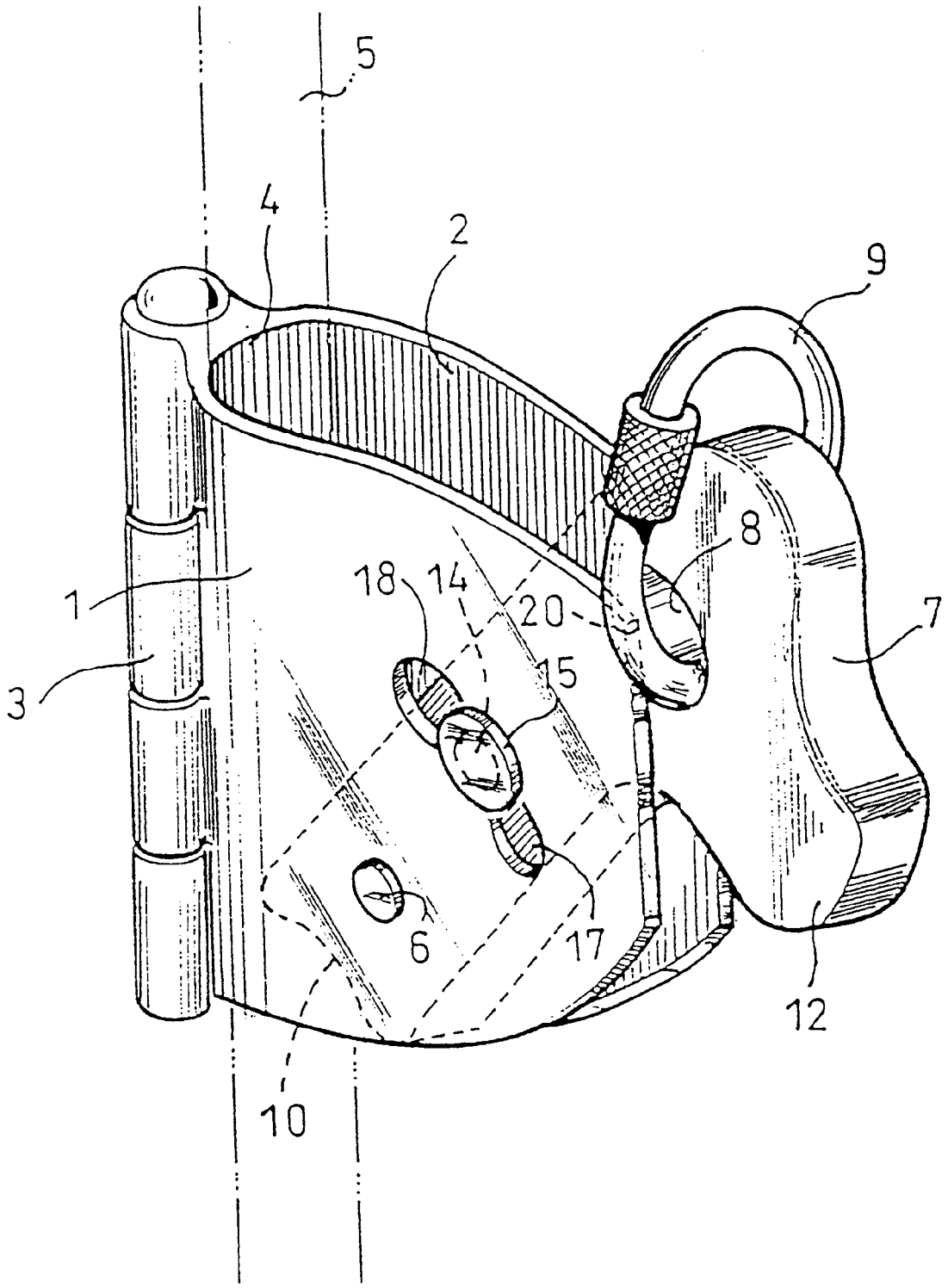
FIG. 1 is a perspective view of a first embodiment of a device of the invention.
Figure 3:
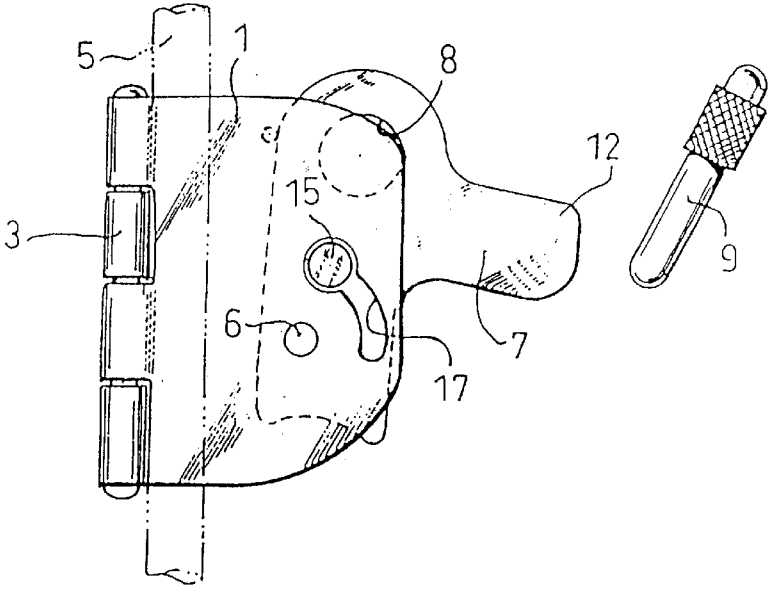
FIG. 3 is a side view with the device in its open position.
Figure 2:
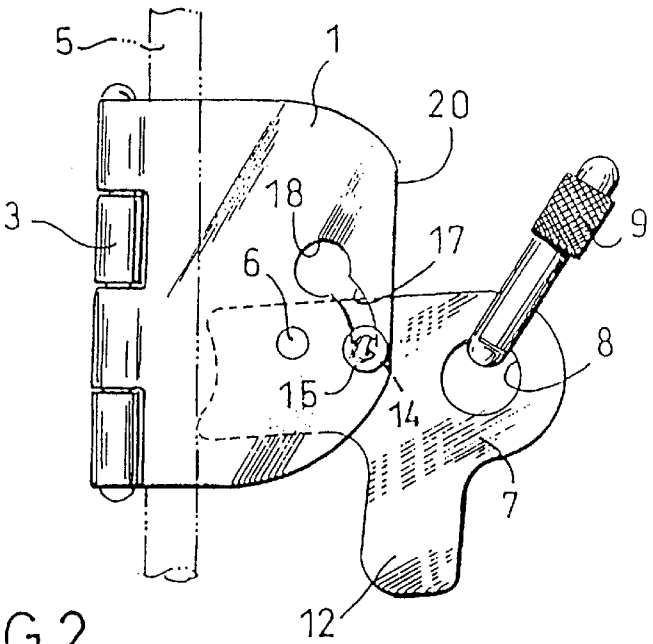
FIG. 2 is a side view with the device in its blocked position.
Figure 4:
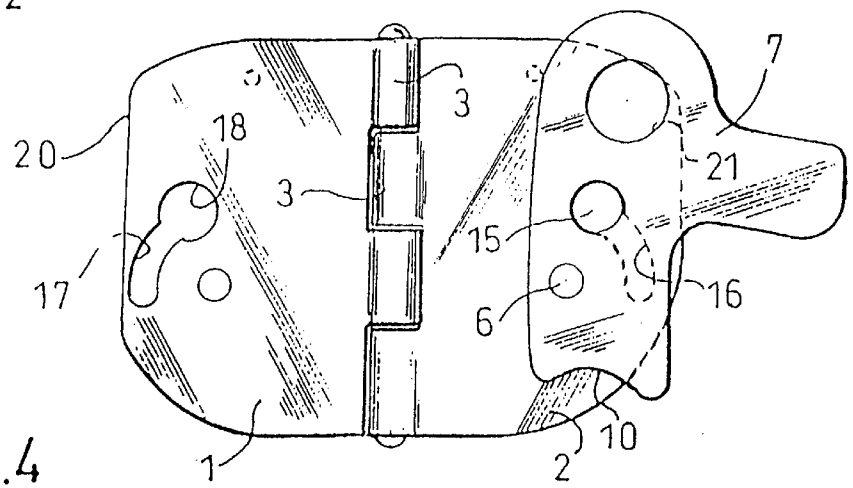
FIG. 4 shows a view of the open device.

FIGS. 1 to 4 show a first embodiment. The device shown in these figures comprises two flanges 1 and 2 connected by a hinge 3 which form between them a channel 4 for guiding a vertical cable 5 extending along one wall.

On flange 2 a lever 7 is articulated about an axle 6. One extremity of lever 7 is terminated by an opening 8 which receives a snap hook or other link 9. The other extremity of lever 7 is terminated by a cam 10 which co-operates with cable 5 in the event of a fall (see FIG. 2) to block the device on the cable by pinching the latter between cam 10 and channel 4.

Lever 7 comprises a lateral projection 12 which allows the user to place the lever in its locked position.

Lever 7 is integral with a pin 14 which projects from the two faces of lever 7 and which is terminated by a head 15 on the flange 1 side.

Flange 2 comprises a groove 16 forming an arc of a circle with axle 6 as its center and with which pin 14 co-operates.

Flange 1 comprises a groove 17 corresponding to groove 16 but which is terminated at one extremity by a widened portion, i.e., circular hole 18 corresponding to the diameter of head 15.

Figure 6:
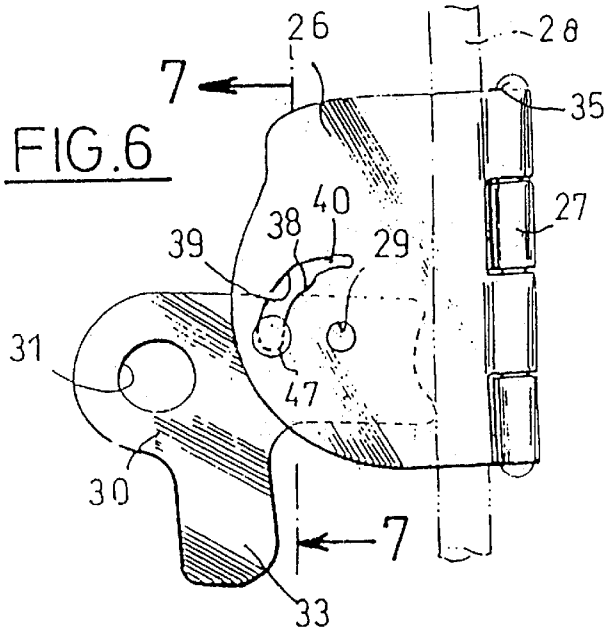
FIG. 6 is a further view of the embodiment of FIG. 5.

As can be seen in FIG. 1 and FIG. 6, the edges of flanges 1 and 2 respectively form abutments 20 and 21, these abutments being positioned so as to limit the swing of the lever towards an open position when link 9 is in position.

The device is positioned by pivoting the two flanges 1 and 2 about hinge 3 to mount it on the cable then the device is closed by introducing head 15 into hole 18 and the device is connected to the user's harness by engaging link 9 in opening 8.

Once link 9 is in position, bearing against abutments 20 and 21, it prevents lever 7 from pivoting into a position in which head 15 coincides with hole 18.

Thus it is impossible to open the device when the link is in place, resulting in high security. As a result, the device must be opened by withdrawing the link 9 and pivoting lever 7 to a rest position in which cam 10 is spaced from cable 5, then head 15 can pass through hole 18.

FIGS. 5 to 9 show a further embodiment of the invention.

The device shown in these figures comprises two flanges 25 and 26 connected by a hinge 27 and delimiting a channel 35 for a cable 28.

A lever 30 is articulated about an axle 29, one extremity of lever 30 comprising an opening 31 for a link, while the other extremity terminates in a cam 32 intended to block the cable 28 in channel 35 in the event of a fall.

The lever comprises a lateral projection 33 to allow the user to pivot the lever in the event of a fall.

Flange 25 comprises a groove 36 in the form of an arc of a circle with axle 29 as its center, the groove being terminated at its upper extremity by a widened portion, viz., a circular hole 37.

Flange 26 is pierced by a corresponding groove 38 which has a shoulder 39 near its upper extremity and which is terminated by a narrower portion 40.

A pin 41 is slidably mounted in a bore 50 in lever 30. One extremity of pin 41 is terminated by a head 42, while near its other extremity 47, the pin is integral with a ring 43 having a shoulder 44, a compression spring 45 being mounted on the pin, one end bearing on the bottom of a hollow 48 in the lever and the other end bearing against ring 43.

The diameter of ring 43 allows it to slide freely in groove 38.

The diameter of head 42 corresponds to that of hole 37.

Shoulder 39 of groove 38 is located at a point intermediate thereof such that when ring 43 abuts against the shoulder, the head is at a distance from hole 37.

It can be seen that when the apparatus is mounted on cable 28, with a link engaged in opening 31 of lever 30, if the user falls, the lever will turn in the direction of arrow f (FIG. 5) and thus cam 32 will block the device by co-operating with cable 28.

In this embodiment, the apparatus cannot be disengaged when no pressure is exerted on extremity 47 of pin 41 since ring 43 abuts against shoulder 39.

Figure 9:
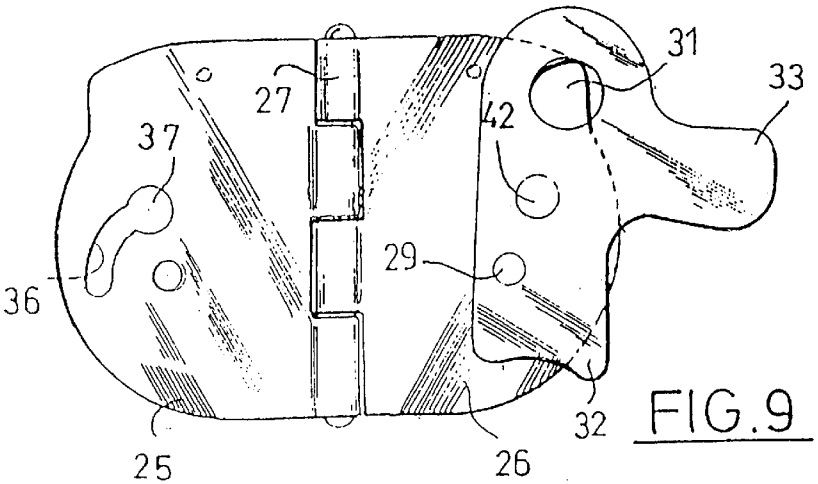
FIG. 9 shows a view of the open device.
Figure 5:
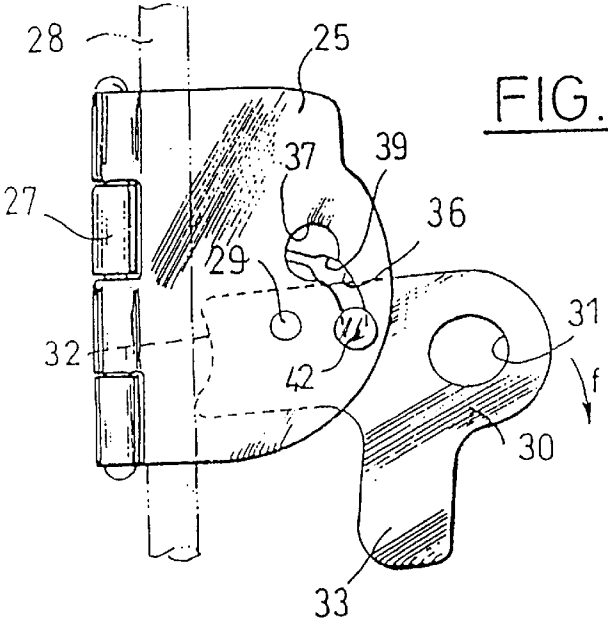
FIG. 5 is a side view of a further embodiment.
Figure 8:
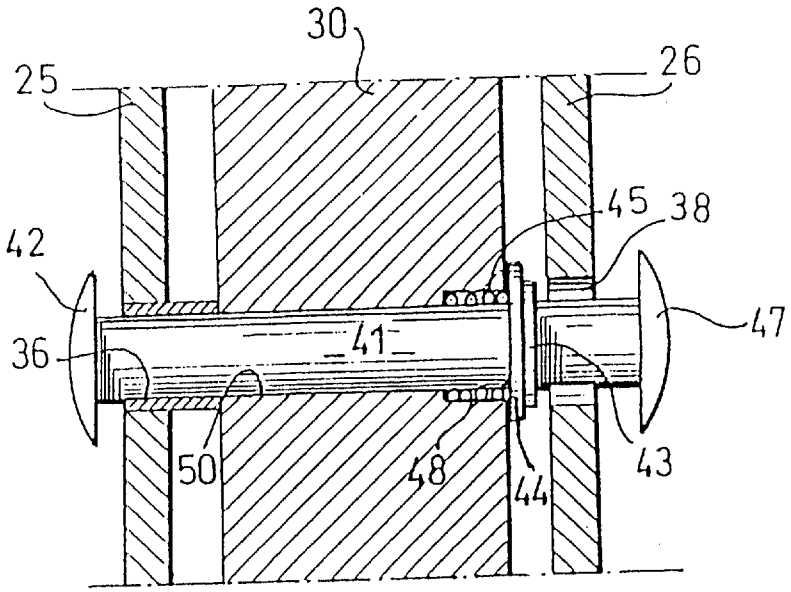
FIG. 8 is a section similar to that of FIG. 7, with the device being unlocked.
Figure 7:
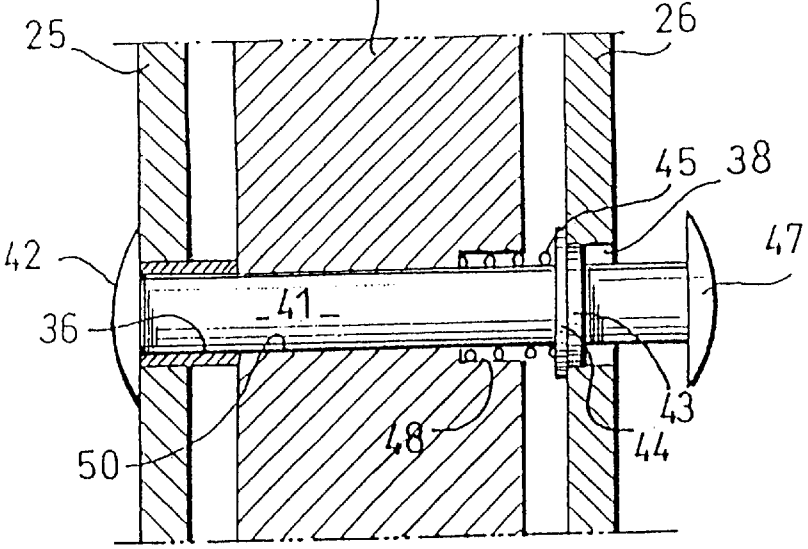
FIG. 7 is a section along the line 7—7 in FIG. 6, the device being locked.

If when the job has been completed the device is to be disengaged, extremity 47 is pushed to cause ring 43 to escape from groove 38; then lever 30 is pivoted to bring it into a rest position so that cam 32 is at a distance from cable 28 and until head 42 comes into a position at right angles to hole 37 and flanges 25 and 26 are then pivoted about hinge 27 (see FIG. 9).

Of course, the invention is not limited to the embodiments shown that have just been described. Many modifications of detail can be made thereto without departing from the scope of the invention.

There is claimed:

1. A fall-preventing device comprising:

a first flange and a second flange, said first and second flanges being connected via a hinge connection and having respective portions spaced apart in a closed operable position of said first and second flanges, said first and second flanges being movable by means of said hinge connection to an open non-operable position to receive a cable, said first and second flanges defining a channel adapted to guide the cable for movement of said first and second flanges with respect to the cable in said closed operable position;

a lever positioned between said first and second flanges, in said closed operable position of said first and second flanges;

a pivot axle extending between said first and second flanges, said lever being mounted for pivotal movement about an axis of said pivot axle, said lever having a cam at one extremity, for engagement with the cable within the channel, and an opening at another extremity, said opening being adapted to receive a link for connection to a harness of a user;

an arcuate groove extending through at least one of said first and second flanges, said arcuate groove having a length extending along a path partially around said axis of said pivot axle;

a guide pin extending from said lever and through said arcuate groove in said closed operable position of said first and second flanges, said guide pin being movable along said length of said arcuate groove from a cable engagement position of said lever to a lever rest position, said cam of said lever being spaced from the cable in said lever rest position, said guide pin having a head positioned outside said one of said first and second flanges to retain said first and second flanges in said closed operable position of said first and second flanges in said cable engagement position of said lever;

said arcuate groove having an enlarged width at a location of said arcuate groove corresponding to said lever rest position for enabling passage of said head of said guide pin for enabling movement of said first and second flanges, by means of said hinge connection, to said open non-operable position;

safety means for opposing movement of said first and second flanges to said open non-operable position when said lever does not occupy said lever rest position.

2. A fall-preventing device comprising:

a first flange and a second flange, said first and second flanges being connected via a hinge connection and having respective portions spaced apart in a closed operable position of said first and second flanges, said first and second flanges being movable by means of said hinge connection to an open non-operable position to receive a cable, said first and second flanges defining a channel adapted to guide the cable for movement of said first and second flanges with respect to the cable in said closed operable position;

a lever positioned between said first and second flanges, in said closed operable position of said first and second flanges;

a pivot axle extending between said first and second flanges, said lever being mounted for pivotal movement about an axis of said pivot axle, said lever having a cam at one extremity, for engagement with the cable within the channel, and an opening at another extremity, said opening being adapted to receive a link for connection to a harness of a user;

an arcuate groove extending through at least one of said first and second flanges, said arcuate groove having a length extending along a path partially around said axis of said pivot axle;

a guide pin extending from said lever and through said arcuate groove in said closed operable position of said first and second flanges, said guide pin being movable along said length of said arcuate groove from a cable engagement position of said lever to a lever rest position, said cam of said lever being spaced from the cable in said lever rest position, said guide pin having a head positioned outside said one of said first and second flanges to retain said first and second flanges in said closed operable position of said first and second flanges in said cable engagement position of said lever;

said arcuate groove having an enlarged width at a location of said arcuate groove corresponding to said lever rest position for enabling passage of said head of said guide pin for enabling movement of said first and second flanges, by means of said hinge connection, to said open non-operable position; and a portion of at least one of said first and second flanges comprising safety structure to block movement of said lever to said lever rest position.

3. A fall-preventing device according to claim 2, wherein:

said safety structure comprises surfaces of said first and second flanges positioned for engagement with the link, when the link is mounted to said lever, to block movement of said lever to said lever rest position.

4. A fall-preventing device according to claim 3 in combination with said link.

5. A fall-preventing device according to claim 4 in further combination with said cable.

6. A fall-preventing device according to claim 2, wherein:

said arcuate groove is a circular arc about said axis of said pivot axle.

7. A fall-preventing device comprising:

a first flange and a second flange, said first and second flanges being connected via a hinge connection and having respective portions spaced apart in a closed operable position of said first and second flanges, said first and second flanges being movable by means of said hinge connection to an open non-operable position to receive a cable, said first and second flanges defining a channel adapted to guide the cable for movement of said first and second flanges with respect to the cable in said closed operable position;

a lever positioned between said first and second flanges, in said closed operable position of said first and second flanges;

a pivot axle extending between said first and second flanges, said lever being mounted for pivotal movement about an axis of said pivot axle, said lever having a cam at one extremity, for engagement with the cable within the channel, and an opening at another extremity, said opening being adapted to receive a link for connection to a harness of a user;

a first arcuate groove extending through said first flange and a second arcuate groove extending through said second flange, said first and second arcuate grooves having lengths extending along a circular path about said axis of said pivot axle;

a guide pin slidably mounted in a bore of said lever and having a first extremity extending through said first arcuate groove in said closed operable position of said first and second flanges, said guide pin a second extremity extending through said second arcuate groove in said closed operable position of said first and second flanges, said guide pin being movable along said lengths of said arcuate grooves from a cable engagement position of said lever to a lever rest position, said cam of said lever being spaced from the cable in said lever rest position;

said first arcuate groove having a narrowed portion at a position corresponding to said lever rest position, said second arcuate groove having an widened portion at a position corresponding to said lever rest position;

said first extremity of said guide pin being integral with a ring, said second extremity of said guide pin being terminated by a head, said ring having a width greater than a width of said narrowed portion of said first arcuate groove;

an elastic means biasing said guide pin to maintain said integral ring of said first extremity of said guide pin in said first arcuate groove;

said guide pin having a manipulable portion adapted to be pushed against said elastic means to move said integral ring of said first extremity of said guide pin from said first arcuate groove to allow movement of said guide pin into said narrowed portion of said first arcuate groove and, thereby, to allow said head of said second extremity of said guide pin to pass through said widened portion of said second arcuate groove as said first and second flanges are moved by means of said hinge connection to said open non-operable position.

8. A fall-preventing device comprising:

a first flange and a second flange, said first and second flanges being connected via a pivot connection for movement of said flanges along an axis from a closed operable position of the device to an open position for receiving a cable between flanges, said flanges defining a channel extending along a direction substantially parallel with said axis, the channel adapted to guide the cable therein;

a lever positioned between said first and second flanges, in said closed operable position, said lever being mounted for pivotal movement about an axis extending through said flanges, said lever having a cam for engagement with the cable within the channel;

an arcuate groove extending through at least one of said first and second flanges;

a guide pin extending from said lever and through said arcuate groove in said closed operable position of said first and second flanges, said guide pin being movable along said length of said arcuate groove from a cable engagement position of said lever to a lever rest position, said cam of said lever being spaced from the cable in said lever rest position, said guide pin having a head positioned outside said one of said first and second flanges to retain said first and second flanges in said closed operable position of said first and second flanges in said cable engagement position of said lever;

said arcuate groove having an enlarged width at a location of said arcuate groove corresponding to said lever rest position for enabling passage of said head of said guide pin for enabling movement of said first and second flanges, by means of said pivot connection, to said open non-operable position;

a portion of at least one of said first and second flanges comprising at least one abutment surface for opposing movement of said lever to said lever rest position; and a manipulable mechanism movable from a blocking position with said abutment surface, for opposing movement of said lever to said lever rest position, to a non-blocking position, for allowing movement of said lever to said lever rest position.

9. A fall-preventing device according to claim 8, wherein:

said manipulable mechanism comprises a link removably attachable to said lever, said link being adapted to be connected to a harness of a user, said link, when attached to said lever, being positioned for engagement with said first and second flanges to oppose movement of said lever to said lever rest position.

10. A fall-preventing device according to claim 8, wherein:

said manipulable mechanism comprises said guide pin;

said arcuate groove comprises a first arcuate groove extending through said first flange;

said device further comprises a second arcuate groove extending through said second flange;

said guide pin is slidably mounted in a bore of said lever and has a first extremity extending through said first arcuate groove in said closed operable position of said first and second flanges, said guide pin a second extremity extending through said second arcuate groove in said closed operable position of said first and second flanges;

said first arcuate groove having a narrowed portion at a position corresponding to said lever rest position, said second arcuate groove having an widened portion at a position corresponding to said lever rest position;

said first extremity of said guide pin being integral with a ring, said second extremity of said guide pin being terminated by a head, said ring having a width greater than a width of said narrowed portion of said first arcuate groove;

an elastic means biasing said guide pin to maintain said integral ring of said first extremity of said guide pin in said first arcuate groove;

said guide pin having a manipulable portion adapted to be pushed against said elastic means to move said integral ring of said first extremity of said guide pin from said first arcuate groove to allow movement of said guide pin into said narrowed portion of said first arcuate groove and, thereby, to allow said head of said second extremity of said guide pin to pass through said widened portion of said second arcuate groove as said first and second flanges are moved by means of said hinge connection to said open non-operable position.

* * * * *